US005615111A

United States Patent [19]

Raskas et al.

[11] Patent Number: 5,615,111

[45] Date of Patent: Mar. 25, 1997

[54] RECORD AND PLAYBACK MEANS FOR FOOTWEAR

[75] Inventors: Eric J. Raskas; Steven S. Schuver, both of St. Louis, Mo.

[73] Assignee: Solefound, Inc., St. Louis, Mo.

[21] Appl. No.: 650,004

[22] Filed: May 16, 1996

Related U.S. Application Data

[63] Continuation of Ser. No. 247,764, May 23, 1994, abandoned.

[51] Int. Cl.[6] ..... A43B 3/00

[52] U.S. Cl. ..... 364/410; 36/136

[58] Field of Search ..... 364/410, 20, 69; 36/136, 132

[56] References Cited

U.S. PATENT DOCUMENTS

| | | | |
|---|---|---|---|
| 3,916,122 | 10/1975 | Sato et al. | 369/7 |
| 3,919,834 | 11/1975 | Murakami et al. | 369/20 |
| 4,266,254 | 5/1981 | Hobrecht et al. | 360/62 |
| 4,571,680 | 2/1986 | Wu | 364/410 |
| 4,646,350 | 2/1987 | Batra | 36/136 |
| 4,703,445 | 10/1987 | Dassler | 364/410 |
| 4,814,661 | 3/1989 | Ratzlaff et al. | 36/136 |
| 5,063,690 | 11/1991 | Slenker | 36/136 |
| 5,285,586 | 2/1994 | Goldston et al. | 36/136 |
| 5,345,700 | 9/1994 | Norment | 36/136 |
| 5,373,651 | 12/1994 | Wood | 36/136 |
| 5,444,767 | 8/1995 | Goetcheus et al. | 379/67 |
| 5,502,463 | 3/1996 | Sasaki et al. | 345/204 |

FOREIGN PATENT DOCUMENTS

| | | | |
|---|---|---|---|
| 9117542 | 11/1991 | WIPO | 369/69 |

*Primary Examiner*—Jessica Harrison
*Attorney, Agent, or Firm*—Haverstock, Garrett and Roberts

[57] ABSTRACT

Record and playback apparatus for footwear adapted to be incorporated in the footwear is disclosed which comprises circuitry for receiving signals, circuitry for recording the signals and storing the signals in a memory, circuitry for playing back the recorded signals from the memory, circuitry for controlling the recording circuitry for recording the signals and the playback circuitry for playing back the signals from the memory, and circuitry for receiving the recorded signals from the playback circuitry for transmitting the recorded signals.

14 Claims, 3 Drawing Sheets

RECORD AND PLAYBACK MEANS FOR FOOTWEAR

This is a continuation of application Ser. No. 08/247,764, filed on May 23, 1994, now abandoned.

BACKGROUND OF THE INVENTION

This invention relates to record and playback means for footwear and in particular to record and playback means for footwear which includes interchangeable modules which store various recorded sounds for playback.

Footwear, most notably athletic footwear, has evolved to such a state that in addition to its primary purposes of providing support and protection for the foot it has taken on other functions. For example, one of these other known functions consists of including inflatable bladders in each shoe to be inflated by the wearer to provide for a better fit. Another known function is to include lights around the sole of the shoe or at the heel portion of the shoe to have a visual display. One example of such a shoe is disclosed in U.S. Pat. No. 4,848,009. Another known function of footwear is to include means for generating music for the wearer of the shoe to play music during use of the footwear. One example of such means for generating music is disclosed in U.S. Pat. No. 4,571,680, which is assigned to the assignee of this application. U.S. Pat. No. 4,571,680 discloses an electronic music pace counting shoe which plays music while the user of the shoe is walking or otherwise using the shoe. Although such electronic music pace counting shoe is useful, one disadvantage associated with its use is that the wearer of the shoe is limited to the music which is included in the electronic device. Therefore it would be advantageous to have a shoe which does not limit the wearer in what music can be played by the electronic means associated with the shoe. Additionally, it would be advantageous to have a shoe which allows the wearer to record music or other sounds for playback by the electronic means associated with the shoe.

SUMMARY OF THE INVENTION

Generally, one form of the invention is record and playback means for footwear adapted to be incorporated in the footwear which comprises means for receiving signals, means for recording the signals and storing the signals in a memory means, means for playing back the recorded signals from the memory means, means for controlling the recording means for recording the signals and the playback means for playing back the signals from the memory means, and means for receiving the recorded signals from the playback means for transmitting the recorded signals.

In another form the present invention is record and playback means for footwear adapted to be incorporated in the footwear which comprises means for receiving a memory module, the memory module comprising memory means having stored therein signals, means for playing back the stored signals from the memory means, means for controlling the playback means to retrieve from the memory means the stored signals, and means for receiving the stored signals from the playback means for transmitting the stored signals.

In general, another form of the present invention is record and playback means for footwear adapted to be incorporated in the footwear which comprises means for receiving signals, means for recording the signals and storing the signals in a first memory means, means For playing back the recorded signals from the first memory means, a second memory means for storing therein signals, means for controlling the recording means for recording the signals and storing the recorded signals in the first memory means and the playback means for playing back the signals from the first memory means or the second memory means, and means for receiving the signals from the first memory means or the second memory means from the playback means for transmitting the stored signals.

In light of the foregoing comments, it will be recognized that a principal object of the present invention is to provide record and playback means for footwear.

A further object of the present invention is to provide record and playback means for footwear which has removable or interchangeable modules which have stored therein different signals or music.

Another object of the present invention is to provide record and playback means for footwear which is simple and easy to use.

A still further object of the present invention is to provide record and playback means for footwear which is convenient, economical, and reliable.

These and other objects and advantages of the present invention will become apparent after considering the following detailed specification in conjunction with the accompanying drawings, wherein:

DETAILED DESCRIPTION OF THE PREFERRED EMBODIMENT

Figure 1:
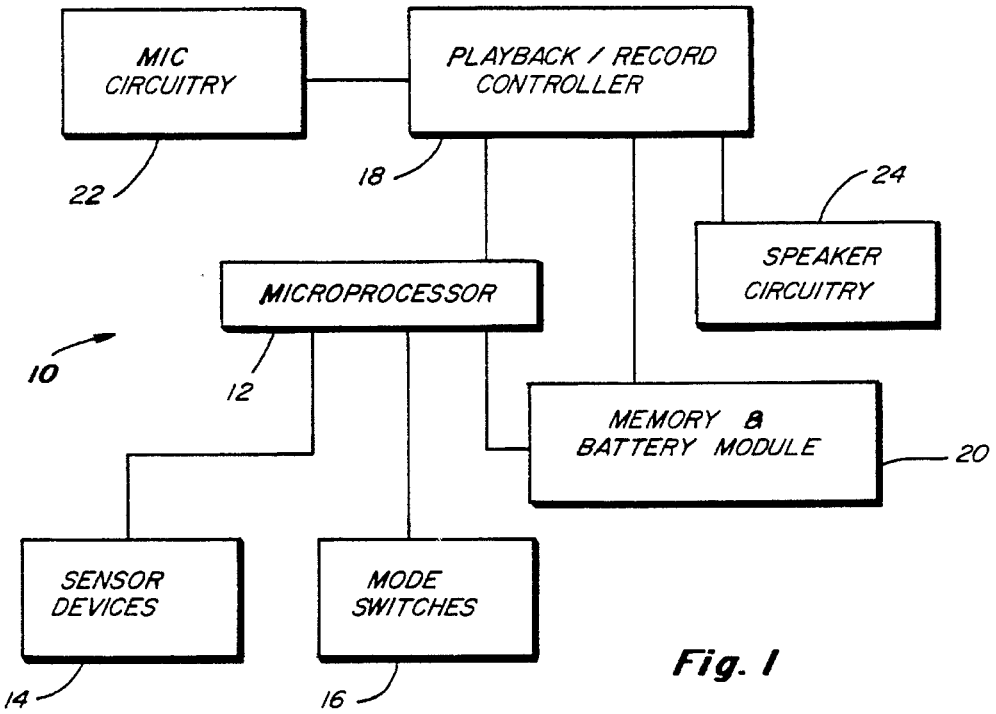
FIG. 1 is a functional block diagram of record and playback means for footwear constructed according to the present invention.

Referring now to the drawings, wherein like numerals refer to like items, number 10 identifies a preferred embodiment of record and playback means for footwear which is constructed according to the present invention. With reference to FIG. 1, the record and playback means for footwear 10 has a microprocessor or microcontroller 12 which has connected to it peripheral devices such as sensor devices 14 and mode switches 16. The microcontroller 12 has connected to it a record/playback controller circuit 18 and the microcontroller 12 controls the functions and operations of the record/playback controller circuit 18. A memory and battery module 20 is connected to both the microcontroller 12 and the record/playback controller circuit 18. The memory and battery module 20 provides power to the microcontroller 12, the record/playback controller 18, and other circuits, as will be explained. Additionally, the memory and battery module 20 has stored therein recorded digital signals to be played back under control of the microcontroller 12 and the record/playback controller 18. Microphone circuitry 22 is operatively connected to the record/playback controller circuit 18 to provide audio signals from the microphone circuitry 22 to the record/playback controller circuit 18. The record/playback controller circuit 18 is further connected to speaker circuitry 24 to provide signals from the record/playback controller circuit 18 to be emitted by the speaker circuitry 24.

Figure 2:
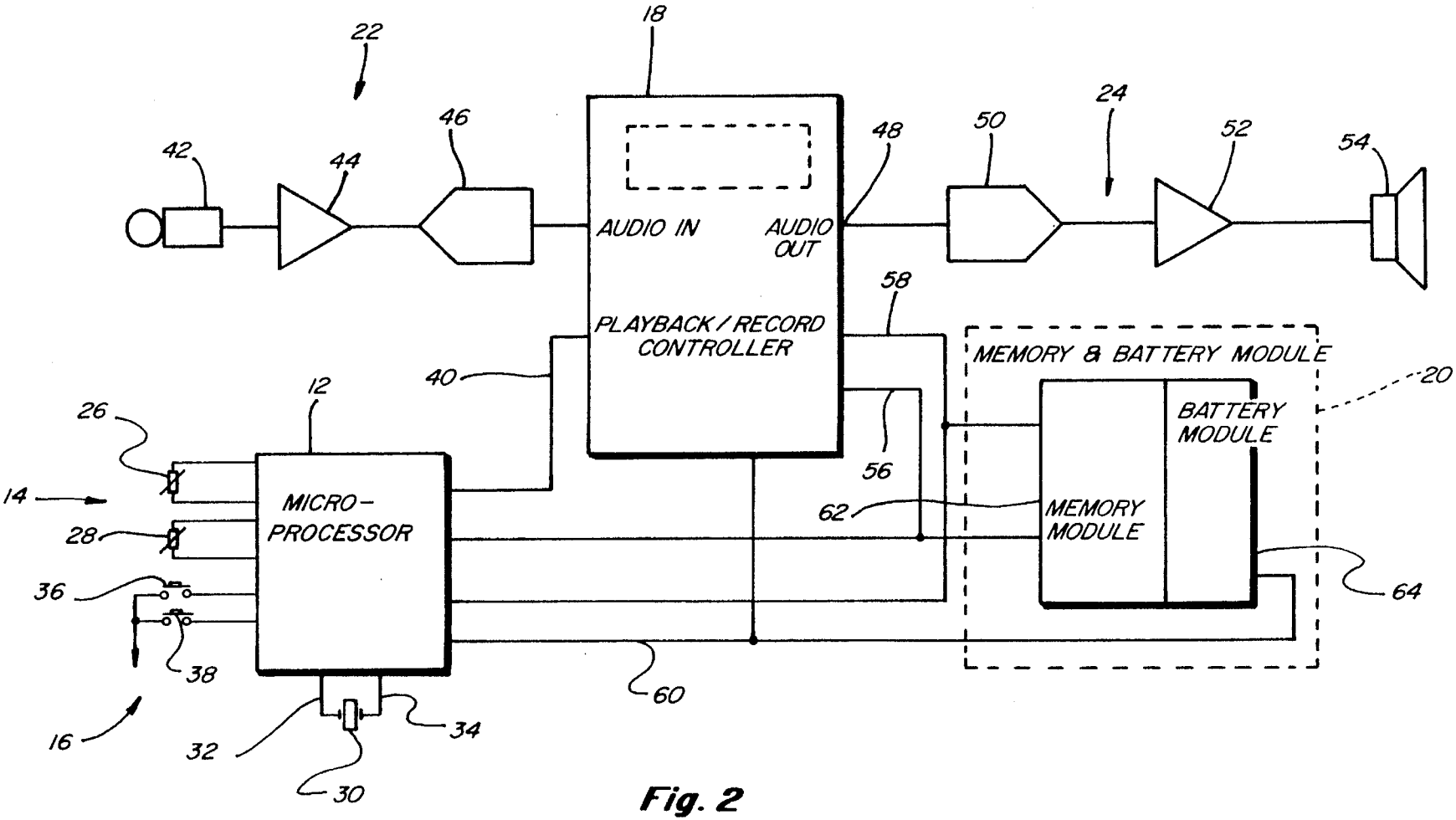
FIG. 2 is a partial block and partial schematic diagram of the record and playback means for footwear of the present invention.

Referring now to FIG. 2, the microcontroller 12 is adapted to monitor the sensor devices 14 and the mode switches 16. The sensor devices 14 include a toe switch or sensor 26 which is incorporated in the toe of the footwear and when the user of the footwear steps down on the toe portion of the footwear the toe sensor 26 will be actuated. The sensor devices 14 further include a heel switch or sensor 28 which is incorporated in the heel of the footwear. Pressing down on the heel portion of the footwear will actuate the heel sensor 28 and a signal will be sent to the microcontroller 12. The sensor devices 14 are used to control various functions of the microcontroller 12, as will be explained. The microcontroller 12 also has a clock crystal 30 connected to inputs 32 and 34 of the microcontroller 12. Although a clock crystal 30 is shown it is also possible to have other timing devices or clock circuitry for developing timing signals for the microcontroller 12. Microcontroller 12 may be a microcontroller such as an EPROM based 8 bit CMOS microcontroller which is manufactured by Microchip Technology Inc. and designated as the PIC®16C5X series of microcontrollers. Another example of a microcontroller which may be used as microcontroller 12 is a Zilog Z86C04 microcontroller which is from a series of microcontrollers designated as Z8® microcontrollers. Although microcontrollers have been used as examples for the microcontroller 12 it is also contemplated that microprocessors may be used, such as Intel microprocessors. The mode switches 16 include a record/playback switch 36 and a mode select switch 38. The record/playback switch 36 controls the recording and playback functions of the record/playback controller circuit 18. The mode select switch 38 controls the various modes of the microcontroller 12, such as the on/off power switch for the record and playback means for footwear. Although one mode select switch 38 is shown it is possible to have more than one to control various other functions of the microcontroller 12, as will be explained.

Microcontroller 12 is adapted to control the operation of the record/playback controller circuit 18. The microcontroller 12 is connected to the record/playback controller circuit 18 by a control bus 40. To simplify the drawing figures a single line is used to represent a bus, it should be understood that a bus can have multiple electrical conductors. Additionally, for clarity, chip pins and other chip notations have been omitted. The record/playback controller circuit 18 is further adapted to receive signals from the microphone circuitry 22. The microphone circuitry 22 includes a microphone 42, such as a piezoelectric device or other suitable microphone device, which sends signals to an input amplifier and filter circuit 44 which provides the amplified and filtered signals to an analog to digital converter 46. The digital signals from the analog to digital converter 46 are then provided to an AUDIO IN input of the record/playback controller circuit 18. An example of a record/playback controller circuit 18 is an LR3991 voice recording/playback system which is manufactured by Sharp Corporation. Another example of a record/playback controller circuit 18 is an TMS3478 voice recording/playback CVSD (Continuously Variable Slope Delta) controller which is manufactured by Texas Instruments. The ISD 1012A/1016A/1020A Single-Chip Voice Record/Playback devices manufactured by Information Storage Devices, Inc. which are also designated as the ISD 1000A Family may also be used as the record/playback controller circuit 18. The record/playback controller circuit 18 has the capability of compressed recording to provide for longer recording periods. The record/playback controller circuit 18 further has an AUDIO OUT output 48 which provides signals to the speaker circuitry 24. The speaker circuitry 24 has a digital to analog converter 50 which provides analog signals to an output amplifier 52 which is connected to a speaker 54. Audio signals will be transmitted from the speaker 54 upon receipt of signals from the output amplifier 52. Although the speaker 54 is shown connected to the output of the audio amplifier 52, it is also possible to provide a wireless device such that the speaker circuitry 24 includes an antenna and the speaker 54 is included in a headset so that the sounds will be transmitted from the antenna to the speaker 54 in the headset. Additionally, although one speaker 54 is shown it is also possible to have more than one speaker 54.

The microcontroller 12 has a data bus 56 connected to both the record/playback controller circuit 18 and the memory and battery module 20. An address bus 58 connects together the microcontroller 12, the record/playback controller circuit 18, and the memory and battery module 20. A power bus 60 is connected between the memory and battery module 20, the microcontroller 12, and the record/playback controller circuit 18. The memory and battery module 20 includes a memory module 62 for storing signals such as digital signals or audio sounds and a battery module 64 which includes the power source for powering the microcontroller 12, the record/playback controller circuit 18, and the other related devices. The memory module 62 includes nonvolatile memory such as ROM, EPROM, or EEPROM chips and different signals are stored in the memory of the memory module 62. The memory and battery module 20 is a removable unit which may be interchangeable with other memory and battery modules 20 having new or recharged batteries and/or other memory modules having different digital signals or audio signals. For example, some memory modules may contain songs such as classical music while other modules may contain songs such as jazz music. Although the memory module 62 was previously described as including nonvolatile memory it is also possible that the memory module 62 include volatile memory such as RAM, SRAM, and/or DRAM. Memory modules 62 including volatile memory may be used to record signals to be used with other footwear having record and playback means. Also, the memory module 62 may include a combination of nonvolatile and volatile memory. Additionally, other memory modules may contain voice signals, such as recordings of readings from books. It is also contemplated that the battery module 64 may be separate from the memory module 62 and the battery module 64 may be an easily removable unit which may be interchangeable with other battery modules having new or recharged batteries.

Although the circuitry is shown and described as separate devices or chips, it is also possible that all of the circuitry may be incorporated into a single chip. For example, if a Sharp LR3991 system is used as the record/playback controller circuit 18, the analog to digital converter 46 and the digital to analog converter 50 circuits would be incorporated in the Sharp LR3991 system.

The microcontroller 12 operates in accordance with a main program stored in program memory. In the case of the PIC®16C5X series of microcontrollers, the main program would be stored in EPROM program memory which is on the chip. Microcontroller 12 is programmed in a conventional manner to segregate and interpret the information from the sensor devices 14 and the mode switches 16. Some of the more important program steps of the microcontroller 12 will be summarized hereinafter. In order to operate the record and playback means for footwear 10 the user turns on the power by actuating one of the mode switches 16, such as one of the mode select switches 38. Once the record and playback means 10 is turned on the user may select either the record mode to record sounds or the playback mode to playback previously recorded sounds. For example, one of the mode switches 16, such as switch 36, is selected to operate the record function of the record and playback means 10. Once the switch 36 is pressed the user may record digital signals, audio signals such as music or the user's voice. Signals are recorded through the microphone circuitry 22 and stored in memory associated with the record/playback controller 18. Although microphone circuitry 22 is shown as the input means for inputting signals to be recorded it is also possible to have other input means for providing signals to be recorded. The recorded signals may be played back by selecting one of the mode switches 16 which corresponds to the playback function. Once the recorded signals are selected for playback, the signals are retrieved from memory and sent through the speaker circuitry 24 to be played over the speaker 54. The mode switches 16 may also be used to select a particular signal or sound stored in memory to be played back. In another mode, signals which are stored in the memory module 62 may be selected for playback by operation of one of the mode switches 16. Once the appropriate mode switch 16 has been pressed, signals are retrieved from the memory module 62 to be sent through the record and playback controller 18 to the speaker circuitry 24 to be played over the speaker 54. The mode switches 16 may also be used to select a particular song stored in the memory module 62. Additionally, a display device, such as an LCD (liquid crystal display) may be connected to the record and playback controller 18 to display the particular song selected or the location in the memory module 62 where the particular song is located. The sensor devices 14 may be used to set the pace that the music or sounds are played back. For example, when running music is played back at a faster pace than while walking.

Figure 3:
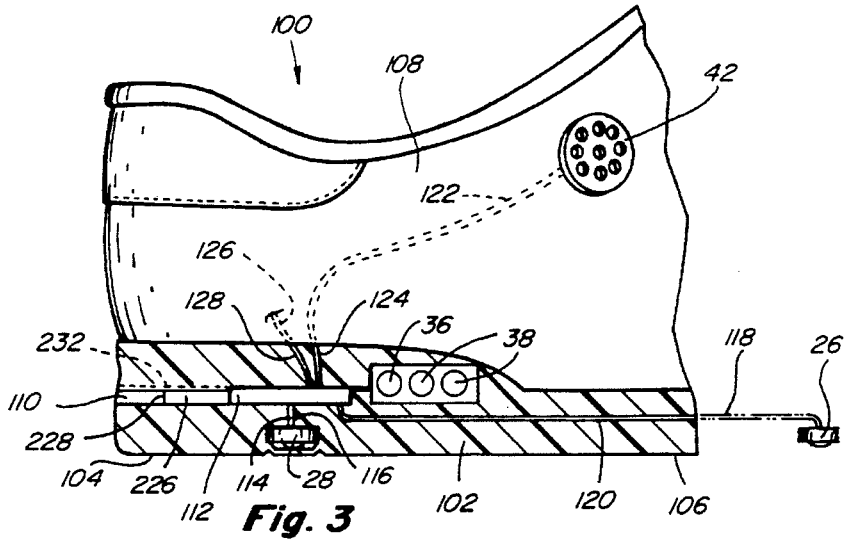
FIG. 3 is a partial cross-sectional and partial perspective view of a shoe which illustrates the location of the circuitry, switches, sensors, and modules of the record and playback means for footwear constructed in accordance with the present invention.

Referring now to FIG. 3, a partial fragmentary and partial cross-sectional view of a shoe 100 is illustrated with the main components of the record and playback means for footwear 10. The shoe 100 includes a sole 102 having a heel portion 104 and a toe portion 106. The shoe 100 also includes an upper portion 108 which is attached to the sole 102. The sole 102 has a cavity 110 within which is placed a module 112 which includes the microcontroller 12, the record/playback controller circuit 18, input amplifier 44, analog to digital converter 46, digital to analog converter 50, and amplifier 52. The heel sensor 28 is connected to the module 112 by a flexible conductor 114 through an appropriate conduit 116 formed in the sole 102. The toe sensor 26 is connected to the module 112 by a flexible conductor 118 through an appropriate conduit 120 formed in the sole 102.

Figure 4:
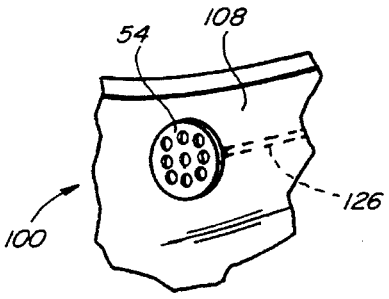
FIG. 4 is an enlarged partial fragmentary view of the shoe of FIG. 3 which illustrates the speaker and associated wiring of the record and playback means for footwear of the present invention.

The microphone 42, which is located in the upper portion 108, is connected by a flexible conductor 122 through the material which forms the upper portion 108 and a conduit 124 which is formed in the sole 102. The microphone 42 is located on the inside or instep portion of the shoe 100. With reference now to FIG. 4, the speaker 54 is disposed in the upper portion 108 of the shoe 100 on the outside of the shoe 100. The speaker 54 is connected by a flexible conductor 126 through the material which forms the upper portion 108 of the shoe 100 and a conduit 128 which is formed in the sole 102. Although the microphone 42 is shown to be located on the inside portion or instep of the shoe 100 and the speaker 54 is shown to be on the outside of the shoe 100 it is possible to reverse the locations of the microphone 42 and the speaker 54 or to have both the microphone 42 and speaker 54 on the same side of the shoe 100.

Referring back to FIG. 3, the record/playback switch 36 and the mode select switches 38 are shown located on the outside of the sole 102. The user of the shoe 100 can easily reach the switches 36 and 38 to control operation of the shoe 100. The switches 36 and 38 are connected to the module 112 by a flexible conductor 130 through a conduit 132 formed in the sole 102. Although the switches 36 and 38 are shown and described located on the sole 102 it is also possible to locate the switches 36 and 38 in or on the upper portion 108 of the shoe 100.

Figure 5:
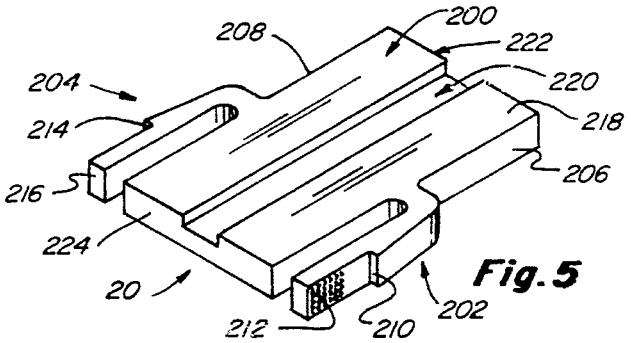
FIG. 5 is a perspective view of a memory and battery module of the record and playback means for footwear.

FIG. 5 illustrates a perspective view of the memory and battery module 20. The module 20 is sized and shaped to fit into the cavity 110 of the shoe 100 in order for the module 20 to mate with or connect to the module 112. As discussed previously, the module 20 contains the memory module 62 and the battery module 64. The module 20 has a main housing 200 having a pair of arms 202 and 204 each extending from opposite sides 206 and 208 of the main housing 200. The arm 202 has a tab portion 210 and a finger grip portion 212. The other arm 204 also has a tab portion 214 and a finger grip portion 216. The arms 202 and 204 are shown in an uncompressed state and are adapted to be compressed when pressed at the finger grip portions 212 and 216. The main housing 200 further has a top 218 in which is formed a channel 220. The main housing 200 also has a front end 222 which includes a connector (not shown) such as any suitable edge connector which is adapted for mating with a complementary connector (also not shown) such as an edge of a circuit board at one end of the module 112. The main housing also has a back end 224 which extends out of the cavity 110 in the sole 102 of the shoe 100 when the module 20 is inserted into the cavity 110. The finger grip portions 212 and 216 also extend out of the cavity 110 when the module 20 is inserted into the cavity 110.

Figure 6:
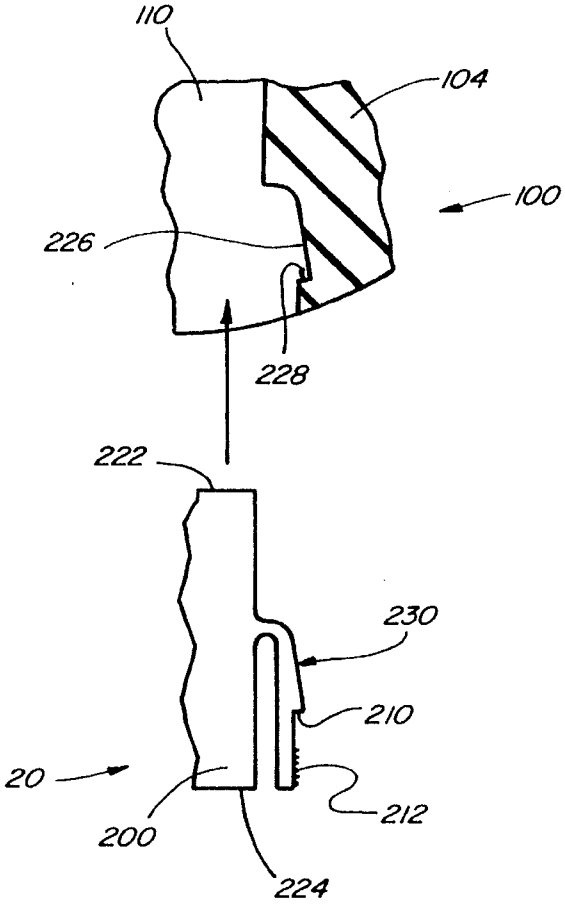
FIG. 6 is a partial cross-sectional and perspective view of the memory and battery module and the shoe.

As depicted in FIG. 6, the module 20 is adapted to be inserted into the cavity 110 of the shoe 100. The cavity 110 includes a recessed area 226 which has a ledge portion 228. The size and shape of the recessed area 226 are similar to an upper portion 230 of the arm 202 and the ledge portion 228 is adapted to receive and retain the tab portion 210 of the arm 202. The other side of the cavity 110 includes a similar recessed area 226 and ledge portion 228. To insert the module 20 into the cavity 110 the arms 202 and 204 are compressed or squeezed towards the main housing 200 and the module 20 is then inserted into the cavity 110 until the connectors of the modules 20 and 112 mate together and the finger grip portions 212 and 216 are then released to allow the arms 202 and 204 to return to their uncompressed state. At this time the tab portions 210 and 214 will contact the ledge portions 228 and the module 20 will be further retained in place. To remove the module 20 from the cavity 110 the finger grip portions 212 and 216, which extend outside of the cavity 110, are pressed to release the tab portions 210 and 214 from their respective ledge portions 228 and the module 20 is pulled out of the connector of module 112 and out of the cavity 110. To insure proper alignment of the module 20 with the module 112, the channel 220 may be provided to be aligned with a rib 232 in the cavity 110, shown as a dotted line in FIG. 3.

Figure 7:
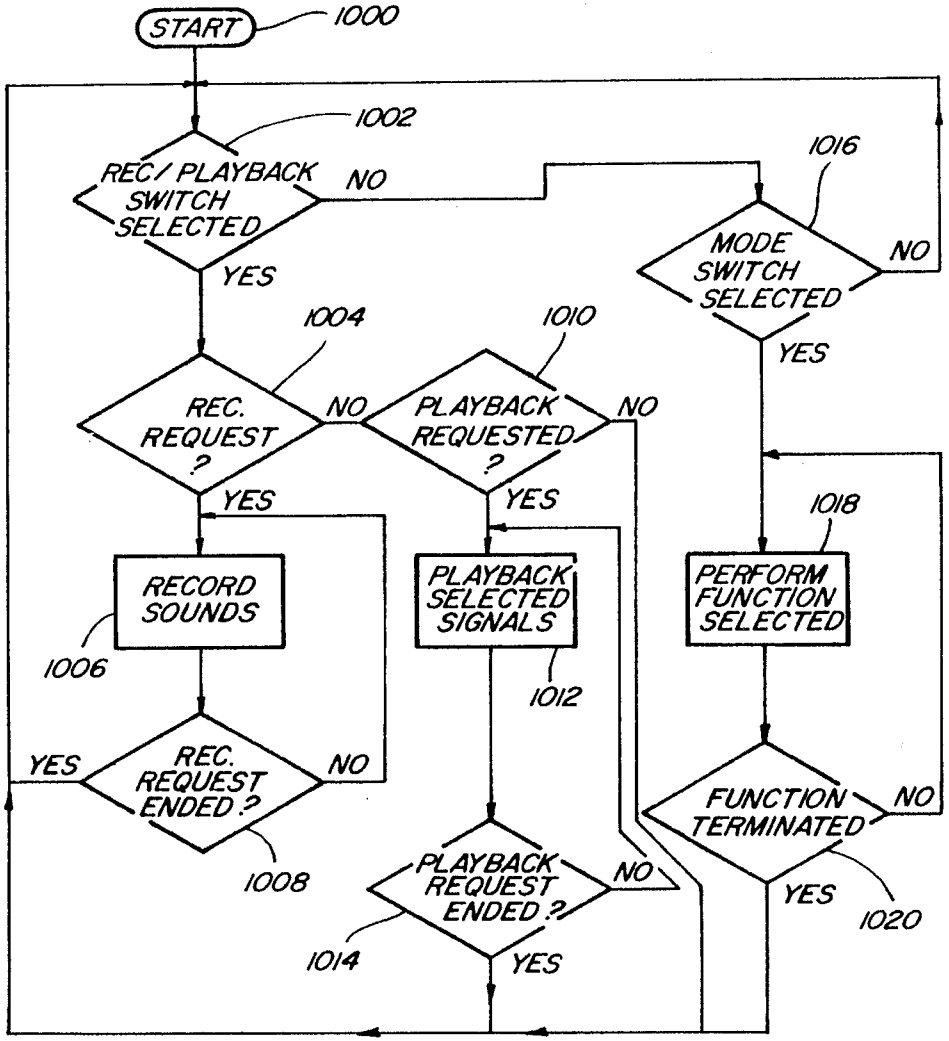
FIG. 7 is a flow chart diagram of a main routine of the operation of the record and playback means for footwear of the present invention.

FIG. 7 summarizes some important steps in operating the preferred embodiment discussed hereinabove. Operations commence with a step 1000 in which the program is started when the power switch, such as mode select switch 38, is pressed. In a next step 1002, it is determined whether the record/playback switch 36 has been selected. If the record/playback switch 36 has been pressed then the program proceeds to a step 1004 to decide whether the record function has been selected. If the record function has been selected the control of the program passes to a step 1006 and the recording process begins. During the recording process signals which are detected by the microphone circuitry 22 are sent to the record/playback controller circuit 18 and stored in the memory within the record/playback controller circuit 18. Control of the program then passes to a step 1008 to determine if the user has decided to stop the recording process. If the record/playback switch 36 has not been depressed the program loops back up to step 1006. When the user determines that the recording process should be ended the record/playback switch 36 is depressed and this operation is detected in step 1008 and the program returns to step 1002.

If back in step 1004 it was determined that the record function was not selected the program branches to a step 1010 to determine if the playback function has been selected. If the playback function has been selected the program continues to a step 1012 and the selected signals are retrieved from memory and sent to the speaker circuitry 24 to be played over the speaker 54. Control of the program then passes to a step 1014 to determine if the user has decided to discontinue the playback of signals. If the record/playback switch 36 has not been depressed the program loops back to the step 1012. When the user decides to end the playback function the record/playback switch 36 is depressed and this operation is detected in step 1014 and the program returns to step 1002. In step 1010 if it is determined that the playback function has not been selected control of the program returns to step 1002. Returning now to step 1002, if the decision is made that the record/playback switch 36 has not been pressed then operation of the program branches to a step 1016. In step 1016 a determination is made as to whether another mode select switch has been selected. If it is determined that another mode select switch 16 has been selected then the function is performed as indicated in a step 1018. Control of the program then passes into a step 1020 to determine if the user has decided to end the selected function. If the selected function has been ended the program returns to step 1002, otherwise the program loops back to step 1018. In step 1016 if no other mode select switch 16 was pressed the program branches back to step 1002 to begin again.

From all that has been said, it will be clear that there has thus been shown and described herein record and playback means for footwear which fulfills the various objects and advantages sought therefor. It will be apparent to those skilled in the art, however, that many changes, modifications, variations, and other uses and applications of the subject record and playback means for footwear are possible and contemplated. All changes, modifications, variations, and other uses and applications which do not depart from the spirit and scope of the invention are deemed to be covered by the invention, which is limited only by the claims which follow.

What is claimed is:

1. Record and playback apparatus for footwear comprising a shoe having an upper portion and a sole having a side and a cavity and the shoe having incorporated therein a removable memory module, means for retaining the memory module within the cavity of the sole, the memory module comprising a memory means having stored therein signals, means for playing back the stored signals from the memory means, means for controlling the playback means to retrieve from the memory means the stored signals, the controlling means further comprising switch means positioned on the side of the sole, means for receiving the stored signals from the playback means for transmitting the stored signals, the apparatus further comprising means for receiving audio signals, means for recording the audio signals and storing the recorded audio signals in the memory means, the playback means for playing back the recorded audio signals from the memory means, the controlling means for controlling the recording means and the playback means, and the transmitting means for transmitting the recorded audio signals.

2. The record and playback apparatus for footwear of claim 1 further comprising input means for activating the playback means.

3. The record and playback apparatus 2 wherein the controlling means comprises a microcontroller connected to the input means for receiving signals from the input means for controlling activation of the playback means.

4. The record and playback means of claim 1 wherein the playback apparatus comprises a controller circuit.

5. The record and playback apparatus of claim 1 wherein the memory module is replaceable with other memory modules.

6. The record and playback apparatus of claim 1 wherein the sole comprises means for retaining the memory module within the sole.

7. Record and playback apparatus of claim 6 wherein the memory module further comprises means for releasing the module from the retaining means within the sole.

8. Record and playback apparatus for footwear comprising a shoe having an upper portion and a sole and the shoe having incorporated therein means for receiving audio signals, a first memory means, means for recording the audio signals and storing the recorded audio signals in the first memory means, means for playing back the recorded audio signals from the first memory means, a second memory means for storing therein signals, means for controlling the recording means for recording the audio signals and storing the recorded audio signals in the first memory means and the playback means for playing back the audio signals from the first memory means or the stored signals from the second memory means, means for receiving the audio signals from the first memory means or the stored signals from the second memory means from the playback means for transmitting the audio signals or the stored signals, the sole having a side and a cavity and the second memory means comprising a module which is inserted into the cavity, the controlling means further comprising switch means positioned in the side of the sole.

9. The record and playback apparatus of claim 8 further comprising input means for selecting activation of the recording means and the playback means.

10. The record and playback apparatus of claim 9 wherein the controlling means comprises a microcontroller connected to the input means for receiving signals from the input means for controlling activation of the recording means and the playback means.

11. The record and playback apparatus of claim 8 wherein the sole further comprises means for retaining the second memory means within the cavity.

12. The record and playback apparatus of claim 11 wherein the module of the second memory means is removable from the retaining means and replaceable with other modules having different signals stored therein.

13. The record and playback apparatus of claim 11 wherein the module of the second memory means further comprises means for releasing the module from the retaining means within the sole.

14. The record and playback apparatus of claim 11 further comprising means for supplying power to the controlling means, the recording means, and the playback means, and wherein the supplying means is incorporated within the module of the second memory means.

* * * * *

UNITED STATES PATENT AND TRADEMARK OFFICE

CERTIFICATE OF CORRECTION

PATENT NO. : 5,615,111

DATED : March 25, 1997

INVENTOR(S) : Eric J. Raskas, et al

It is certified that error appears in the above-indentified patent and that said Letters Patent is hereby corrected as shown below:

Column 1, line 66, "For" should be --for--.

Column 8, line 27, after "apparatus" insert --of claim--.

Column 8, line 31, "means" should be --apparatus--.

Signed and Sealed this

Twenty-second Day of July, 1997

Bruce Lehman

*Attest:*

BRUCE LEHMAN

*Attesting Officer*

*Commissioner of Patents and Trademarks*